US009806420B2

(12) United States Patent
Church et al.

(10) Patent No.: US 9,806,420 B2
(45) Date of Patent: Oct. 31, 2017

(54) NEAR FIELD TUNABLE PARASITIC ANTENNA

(71) Applicant: The United States of America as represented by the Secretary of the Navy, Washington, DC (US)

(72) Inventors: Justin A. Church, San Diego, CA (US); Ricardo Santoyo-Mejia, Chula Vista, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 293 days.

(21) Appl. No.: 14/793,526

(22) Filed: Jul. 7, 2015

(65) Prior Publication Data

US 2015/0311585 A1 Oct. 29, 2015

Related U.S. Application Data

(63) Continuation-in-part of application No. 13/494,111, filed on Jun. 12, 2012, now Pat. No. 9,112,258.

(51) Int. Cl.

| | |
|---|---|
| ***H01Q 1/48*** | (2006.01) |
| ***H01Q 7/00*** | (2006.01) |
| ***H01Q 21/24*** | (2006.01) |
| ***H01Q 5/35*** | (2015.01) |

(52) U.S. Cl.

CPC ..... *H01Q 7/005* (2013.01); *H01Q 5/35* (2015.01); *H01Q 21/24* (2013.01)

(58) Field of Classification Search

CPC ..... H01Q 7/005; H01Q 5/35; H01Q 21/24
USPC ..... 343/741, 745, 749, 797, 866, 848
See application file for complete search history.

(56) References Cited

U.S. PATENT DOCUMENTS

| | | | | |
|---|---|---|---|---|
| 6,590,541 | B1 * | 7/2003 | Schultze | H01Q 1/36 343/741 |
| 9,112,258 | B1 * | 8/2015 | Church | H01Q 7/005 |
| 9,293,299 | B2 * | 3/2016 | Yamazawa | |
| 9,293,828 | B2 * | 3/2016 | Bevelacqua | H01Q 9/0442 |
| 2009/0140946 | A1 | 6/2009 | Ziolkowski et al. | |
| 2010/0201578 | A1 * | 8/2010 | Parsche | H01Q 1/242 343/700 MS |
| 2014/0292598 | A1 * | 10/2014 | Bevelacqua | H01Q 9/0442 343/745 |
| 2015/0318607 | A1 * | 11/2015 | Chieh | H01Q 1/36 343/749 |

OTHER PUBLICATIONS

Harold A. Wheeler; The Radiansphere Around a Small Antenna; Proceedings of the IRE, pp. 1325-1331; Aug. 1959.

(Continued)

*Primary Examiner* — Lam T Mai
(74) *Attorney, Agent, or Firm* — SPAWAR Systems Center Pacific; Kyle Eppele; J. Eric Anderson

(57) ABSTRACT

An antenna comprising: a conductive ground plane; a conductive half loop grounded to the ground plane and configured to be fed with a radio frequency (RF) signal; a single, unitary, three-sided, conductive cage positioned so as to cover the half loop; and dielectric mounts disposed between the cage and the ground plane such that the cage is electrically insulated from the ground plane.

20 Claims, 6 Drawing Sheets

(56) References Cited

OTHER PUBLICATIONS

Richard W. Ziolkowski et al.; Design and Experimental Verification of a 3D Magnetic EZ Antenna at 300 MHz; IEEE Antennas and Wireless Propagation Letters, vol. 8, 2009.
Justin Church et al.; UHF Electrically Small Box Cage Loop Antenna With an Embedded Non-Foster Load; IEE Antennas and Wireless Propagation Letters, vol. 13, Jul. 8, 2014.

* cited by examiner

NEAR FIELD TUNABLE PARASITIC ANTENNA

CROSS-REFERENCE TO RELATED APPLICATION

This application is a continuation-in-part of prior U.S. application Ser. No.: 13/494,111, filed 12 Jun. 2012, titled "Electrically Small Circularly Polarized Antenna" (Navy Case #101173), which application is hereby incorporated by reference herein in its entirety.

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 102936.

BACKGROUND OF THE INVENTION

This invention relates to the field of electrically small antennas. Electrically small antennas have narrow bandwidth limitations and are susceptible to environmental changes. There exists a need for an improved antenna that is able to reconfigure its resonant frequency to adapt to environmental changes.

SUMMARY

Described herein is an antenna comprising a conductive ground plane, a conductive half loop, a single, unitary, three-sided, conductive cage, and dielectric mounts. The conductive half loop is grounded to the ground plane and configured to be fed with a radio frequency (RF) signal. The conductive cage is positioned so as to cover the half loop. The dielectric mounts are disposed between the cage and the ground plane such that the cage is electrically insulated from the ground plane.

A tunable, electrically small (where ka<0.5, where the antenna may be contained within an imaginary sphere having a radius a, and where k is a wave number) embodiment of the antenna described herein may be provided according to the following steps. The first step involves providing a conductive ground plane. The next step provides for grounding a conductive half loop to a center of the ground plane. The next step provides for impedance matching the antenna by covering the half loop with a single, unitary, three-sided, conductive cage so as to create capacitive fields that cancel inductive fields generated by the half loop. The next step provides for electrically insulating the cage from the ground plane by disposing dielectric mounts between the cage and the ground plane. The next step provides for feeding the half loop with a radio frequency (RF) signal to create an omni-directional, linearly polarized radiation pattern.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
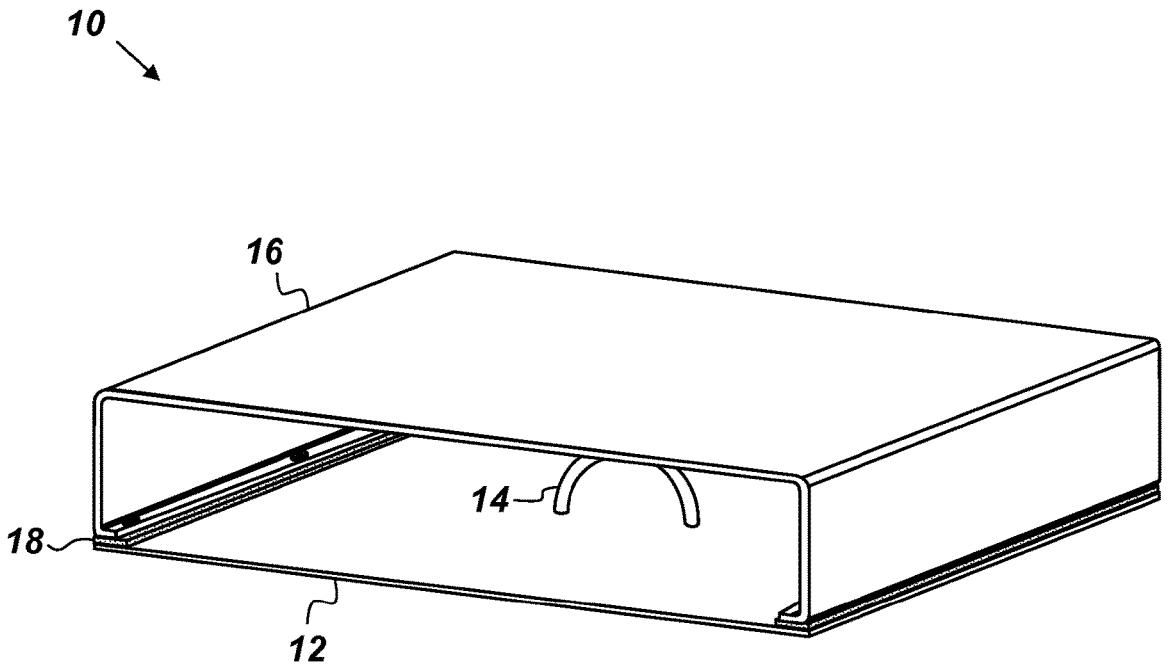
FIG. 1 is a perspective view of an embodiment of an electrically small antenna.

FIG. 1 is an illustration of an embodiment of an electrically small, Near Field Resonant Parasitic (NFRP) antenna 10 that comprises, consists of, or consists essentially of a conductive ground plane 12, a conductive half loop 14, a conductive cage 16, and dielectric mounts 18. The half loop 14 is grounded to the ground plane 12 and configured to be fed with a radio frequency (RF) signal. The cage 16 may be a single, unitary, three-sided, conductive cage positioned so as to cover the half loop 14. The dielectric mounts 18 may be disposed between the cage 16 and the ground plane 12 such that the cage 16 is electrically insulated from the ground plane 12.

The ground plane 12 may be made of any conductive material that provides an adequate ground plane for the antenna 10. The ground plane 12 may have any desired size and shape. For example, the ground plane 12 may be solid or perforated. In one embodiment, the ground plane 12 may be a wire mesh. The ground plane 12 serves as part of the antenna 10 for reflection purposes. In an example embodiment of the antenna 10, the ground plane 12 may have a width and a length that are each 1/12 the operational wavelength when the antenna 10 is operating at 300 MHz.

The half loop 14 may be any conductive half loop. Although the half loop 14 is depicted in FIG. 1 has being a half circle, the half loop 14 is not limited to circular shapes. The half loop 14 may have any desired size and/or shape and may be made of any conductive material. For example, in an embodiment of the antenna 10, the half loop 14 may have a square shape and be made of brass. The half loop 14 may be located in the center of the ground plane 12 with one end grounded to the ground plane 12 and the other end attached to an input feed where the antenna 10 may be connected to a receiver, transmitter, or transceiver.

The cage 16 may be made of any conductive material and have any desired shape. The cage 16 may be formed out of a single piece of material so as to form a unitary, three-sided, conductive cage positioned so as to cover the half loop 14 such as is shown in FIG. 1. In an embodiment of the antenna 10, the height of the cage 16 may be 1/67 the operational wavelength when the antenna 10 is operating at 300 MHz. The cage 16 is configured to surround the half loop 14. The cage 16 may comprise two legs resting on top of the dielectric mounts 18, such as is shown in FIG. 1, but the cage 16 is not limited to that shape and size. The purpose of the cage 16 is to impedance match the antenna 10 at its input by creating capacitive fields near the inductive fields generated by the half loop 14. The inductive and capacitive fields cancel each other allowing for efficient radiation of the antenna 10.

The dielectric mounts 18 may be made of any dielectric material having any desired dielectric constant, $\epsilon_r$ and thickness. The primary purpose of the dielectric mounts 18 is to electrically isolate the cage structure 16 from the ground plane 12, thereby allowing a grounding path to occur exclusively through the capacitive field between the cage 16 and the ground plane 12. In addition, varying $\epsilon_r$ and/or the dielectric thickness of the dielectric mounts 18 changes the effective capacitance generated between the cage structure 16 and the plane 12, which is parallel to the tunable capacitors. A suitable example of the dielectric mounts includes, but is not limited to, Rogers Duriod® 5880 having a thickness of 0.762 millimeters (30 thousandths of an inch).

Figure 2:
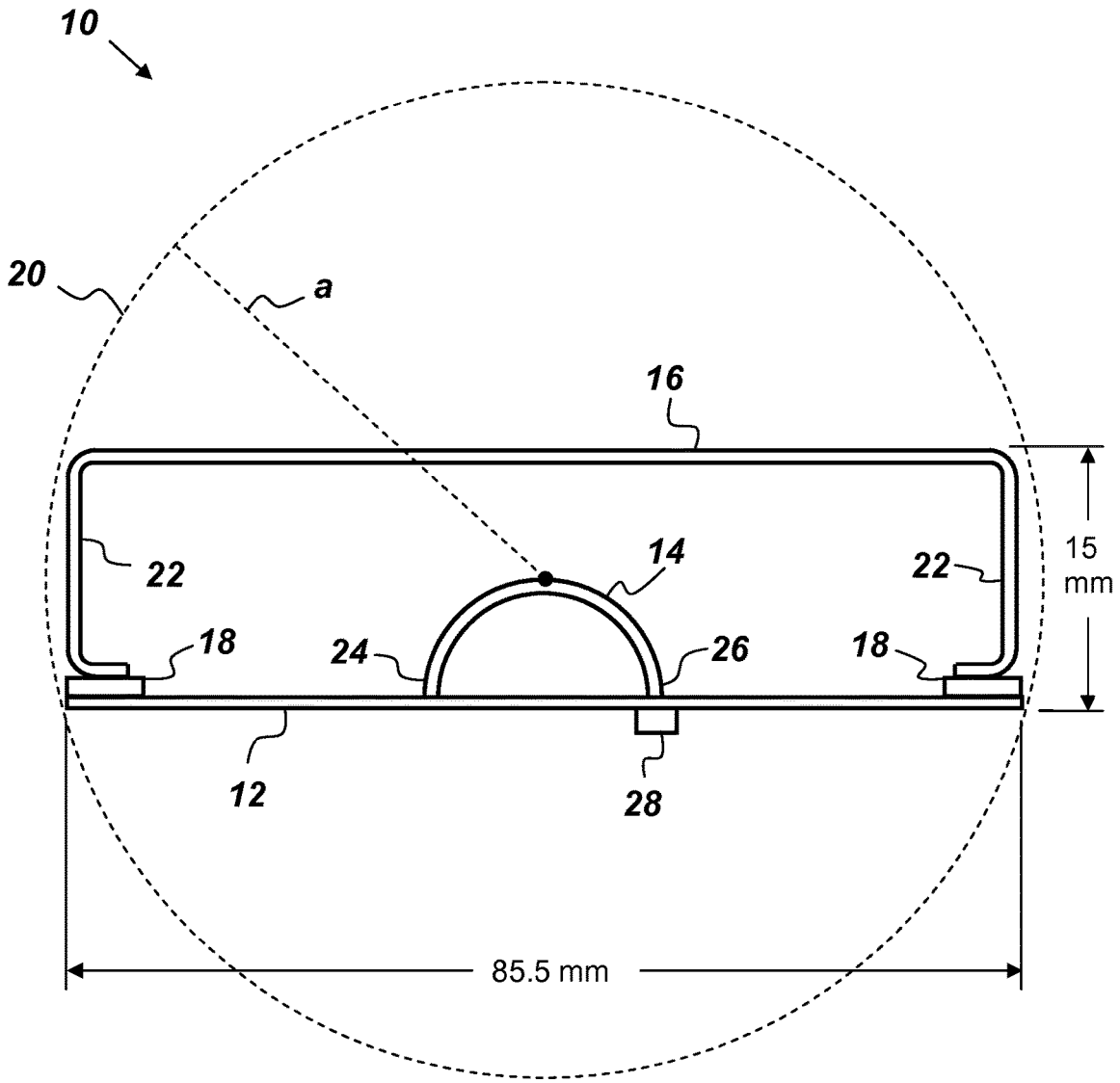
FIG. 2 is a side-view illustration of an electrically-small, linearly-polarized embodiment of an antenna.

FIG. 2 is a side-view illustration of an electrically-small, linearly-polarized embodiment of the antenna 10. As used herein, the term "electrically small" means that the antenna must fit within an imaginary sphere 20 having a radius a such that the product ka is less than 0.5, where k is the wave number of an electromagnetic wave that drives the antenna 10. Stated differently, an electrically small antenna is defined as an antenna with a volume smaller than a radian sphere such that $2\pi a/\lambda<0.5$, where a is the radius of the sphere 20, and $\lambda$ is the free space wavelength. The embodiment of the antenna 10 depicted in FIG. 2 is an efficient electrically small linear polarized antenna for SATCOM communication frequencies (250-350 MHz). In this embodiment of antenna 10, the half loop 14 is made of copper and is fed with an RF signal. A first end 24 of the half loop 14 may be grounded to the ground plane 12, which, in this embodiment, is a nearly flat, square copper sheet having a side length of 85.5 millimeters. A second end 26 of the half loop 14 may be connected to an input feed 28. The half loop 14 may be encapsulated by the cage 16, which, in this embodiment, is formed out of a sheet of copper and comprises two legs 22, which are attached to the dielectric mounts 18.

In the embodiment of the antenna 10 shown in FIG. 2, the antenna 10 is 15 millimeters in height, 85.5 millimeters in width, and 85.5 millimeters in length. The dielectric mounts 18 electrically insulate the cage 16 from the ground plane 12, which in this embodiment is a square copper sheet. The dielectric mounts 18 act as parallel plate capacitors which create electric field components that effectively cancel the large inductive magnetic field components that are created by the radiating half loop 14. This mechanism allows for efficient radiation from an electrically small antenna aperture, without the requirement of an external matching network. This embodiment of the antenna 10 allows for omnidirectional linearly polarized radiation patterns, which allow for universal satellite coverage.

Figure 3:
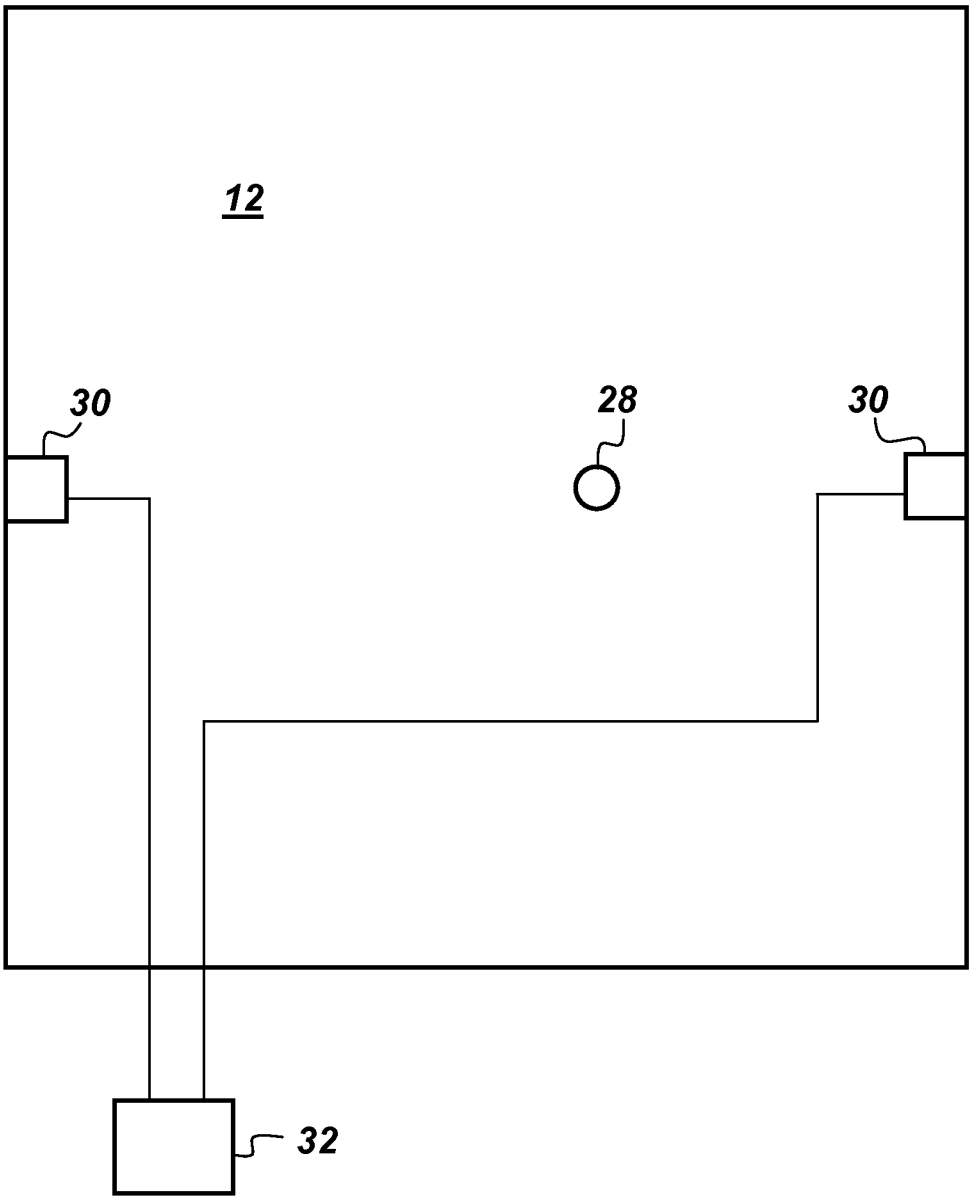
FIG. 3 is a bottom-view illustration of an embodiment an electrically small antenna.

FIG. 3 is a bottom-view illustration of an embodiment the antenna 10 that comprises an even number of at least two tunable capacitors 30 mounted to the underside of the ground plane 12. A controller 32 may be operatively coupled to the capacitors 30 such that the controller 32 is configured to dynamically tune the antenna 10. The controller 32 may tune the antenna 10 to different operating frequencies. In other words, the controller 32 may reconfigure the resonant frequency of the antenna 10. This may be accomplished by varying the capacitance of the cage 16 by tuning the capacitors 30 either manually or automatically. In one embodiment the capacitors may be digital and the controller 32 may be a software programed microcontroller. The ability to tune to different frequencies allows the antenna 10 to transmit and receive within narrow band limits at different frequencies even as the operating environment changes. For example, the antenna 10 may reconfigure its resonant frequency to compensate for the detuning of the resonant frequency which often arises due environmental changes, such as the holding position of the human hand, and/or any nearby metallic structures in the immediate surroundings of the antenna 10. The tunable capacitors 30 may be placed beneath the conducting ground plane 12 of the antenna 10, such that the ground plane 12 serves to reduce electromagnetic coupling (EMC) effects of control lines that are needed for the tunable capacitors 30.

Figure 4:
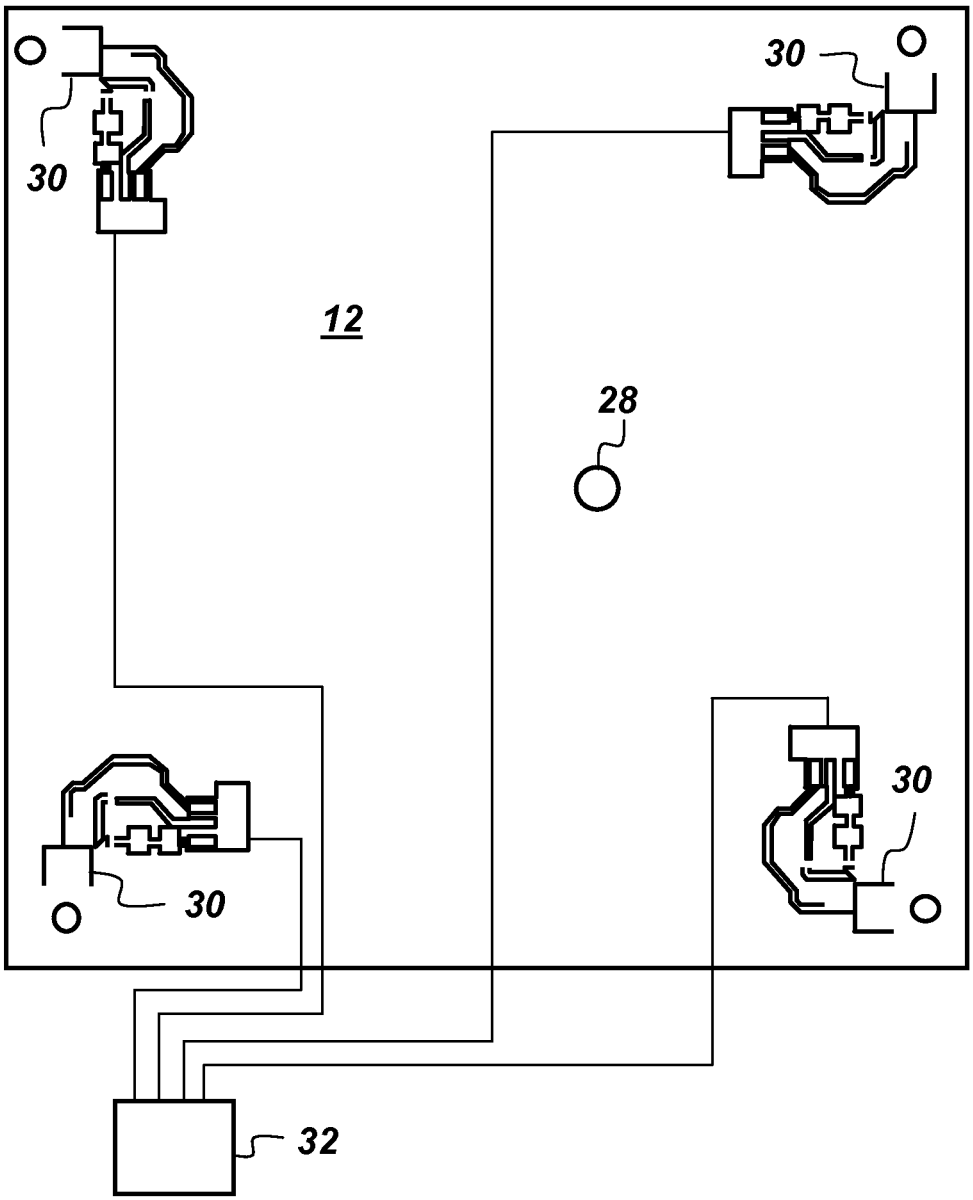
FIG. 4 is a bottom-view illustration of an embodiment an electrically small antenna.

FIG. 4 is a bottom-view illustration of an embodiment of the antenna 10 that comprises four tunable capacitors 30 disposed in the four corners of a square embodiment of the ground plane 12. By varying the capacitance of the capacitors 30, the capacitance of the cage 16 is varied. This variation in capacitance produces a reciprocal variation of the operating frequency of the antenna 10. Therefore, by varying the capacitance of the digitally tunable capacitors 30 the antenna 10 can be manually tuned by a user or dynamically tuned by means of the controller 32. The four capacitors 30 in this embodiment may be tuned simultaneously to the same picoFarad (pF) setting.

Figure 5:
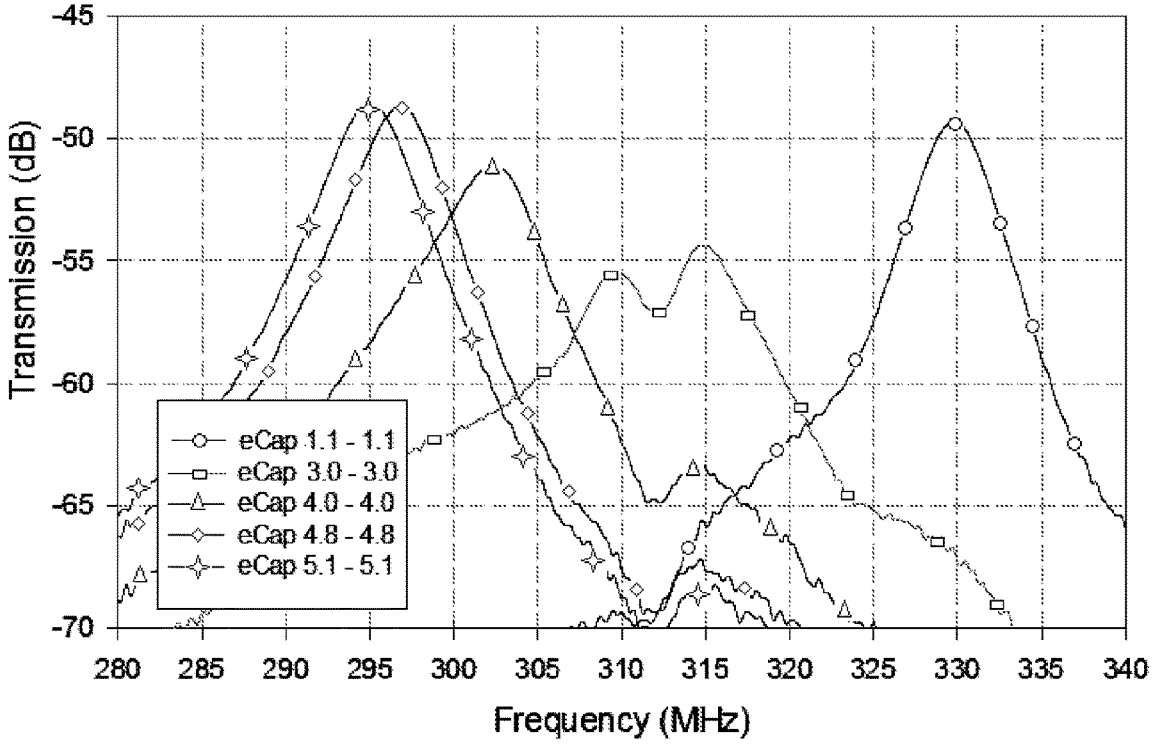
FIG. 5 is a plot showing measured radiated power levels (dB) as a function of frequency (MHz), for various capacitor values (pF).

FIG. 5 is a plot showing measured radiated power levels (dB) of the embodiment of the antenna 10 shown in FIG. 4 as a function of frequency (MHz), for various values (pF) of the tunable capacitors 30. As can be seen here, the resonant frequency of the antenna 10 can be tuned for various capacitor values.

Figure 6:
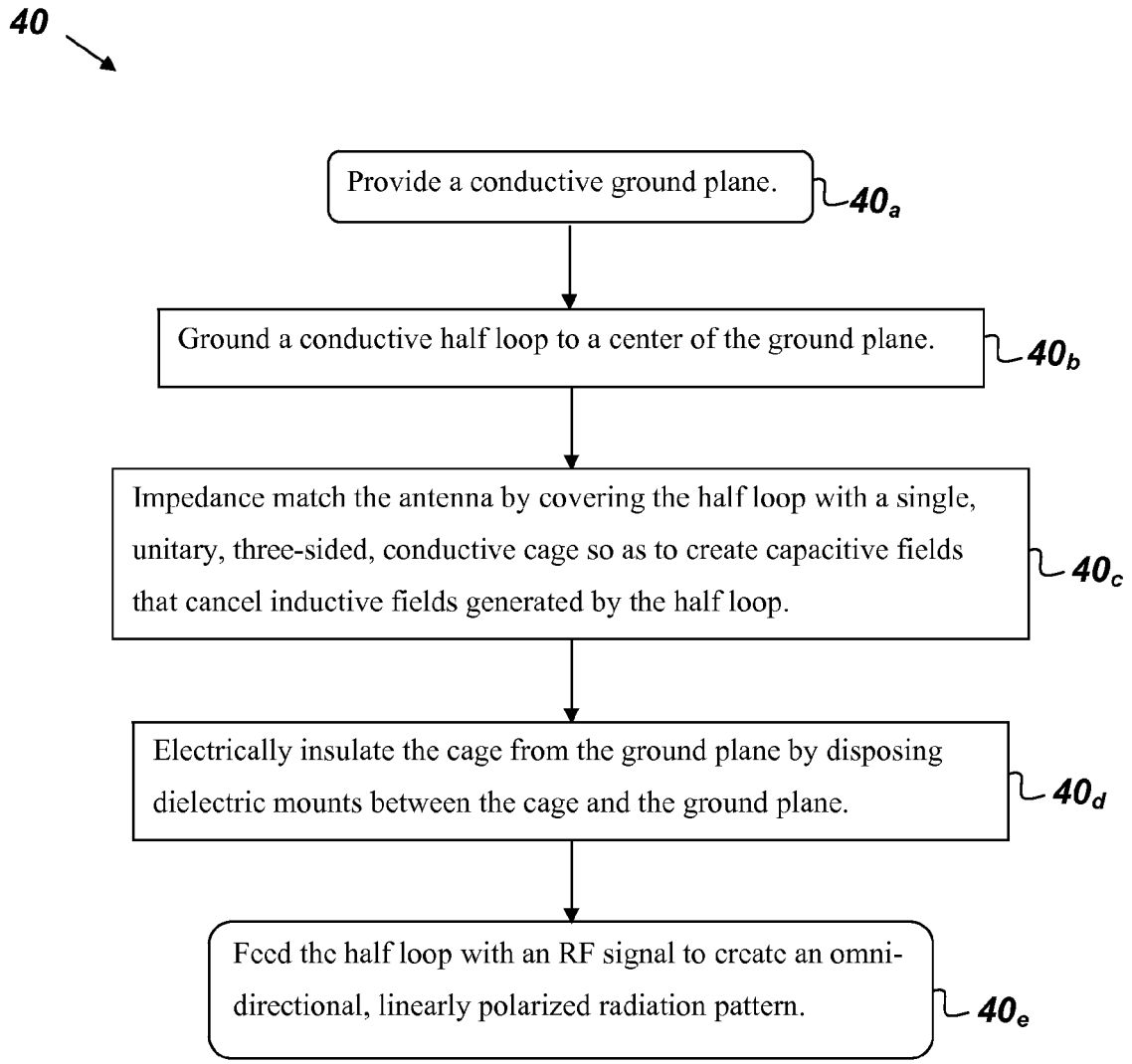
FIG. 6 is a flowchart of a method for providing an electrically small antenna.

FIG. 6 is a flowchart of a method 40 of providing an electrically small embodiment of the antenna 10, comprising the following steps. The first step $\mathbf{40}_a$ entails providing the conductive ground plane 12. The next step $\mathbf{40}_b$ provides for grounding the conductive half loop 14 to a center of the ground plane 12. The next step $\mathbf{40}_c$ provides for impedance matching the antenna 10 by covering the half loop 14 with a single, unitary, three-sided, conductive cage 16 so as to create capacitive fields that cancel inductive fields generated by the half loop 14. The next step $\mathbf{40}_d$ provides for electrically insulating the cage 16 from the ground plane 12 by disposing the dielectric mounts 18 between the cage 16 and the ground plane 12. The next step $\mathbf{40}_e$ provides for feeding the half loop 14 with an RF signal to create an omnidirectional, linearly polarized radiation pattern.

Embodiments of the antenna 10 may be tuned to operate in any desired frequency by tuning the capacitors 30. For example, the antenna 10 may be dynamically tuned with the controller 32 in response to changing environmental conditions experienced by the antenna 10. Examples of changing environmental conditions include, but are not limited to, a change in the way a human operator holds the antenna, a change in distance between the antenna 10 and any nearby metallic structures, and a change in other electromagnetic signals from other devices that may affect the performance of the antenna 10.

From the above description of the antenna 10, it is manifest that various techniques may be used for implementing the concepts of the antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that antenna 10 is not limited to the particular embodiments described herein, but is capable of many embodiments without departing from the scope of the claims.

We claim:

1. An antenna comprising:

a conductive ground plane;

a conductive half loop grounded to the ground plane and configured to be fed with a radio frequency (RF) signal;

a single, unitary, three-sided, conductive cage positioned so as to cover the half loop; and dielectric mounts disposed between the cage and the ground plane such that the cage is electrically insulated from the ground plane.

2. The antenna of claim 1, wherein the antenna fits within an imaginary sphere having a radius a, and wherein a product ka is less than 0.5, where k is a wave number.

3. The antenna of claim 1, further comprising an even number of at least two tunable capacitors mounted to the ground plane.

4. The antenna of claim 3, wherein the dielectric mounts are attached to an upper side of the ground plane and wherein the tunable capacitors are mounted to a lower side of the ground plane.

5. The antenna of claim 3, further comprising a controller operatively coupled to the tunable capacitors such that the controller is configured to dynamically tune the antenna.

6. The antenna of claim 3, wherein there are four tunable capacitors, one mounted to each corner of the ground plane.

7. The antenna of claim 6, wherein the ground plane, loop, and conductive cage are made of copper.

8. The antenna of claim 6, wherein the ground plane, loop, and conductive cage are made of brass.

9. The antenna of claim 1, wherein the antenna does not have an external matching network.

10. The antenna of claim 9, wherein the conductive cage is comprised of a wire mesh.

11. The antenna of claim 9, wherein the conductive cage is solid.

12. The antenna of claim 1, wherein the ground plane has a width that is less than or equal to 1/12 of an operating wavelength, and wherein the conductive cage has a height that is less than or equal to 1/67 the operating wavelength.

13. The antenna of claim 12, wherein the operating frequency is 300 MHz.

14. A method for providing a tunable, electrically small antenna where ka<0.5, where the antenna fits within an imaginary sphere having a radius a, and where k is a wave number, comprising the following steps:

providing a conductive ground plane;

grounding a conductive half loop to a center of the ground plane;

impedance matching the antenna by covering the conductive half loop with a single, unitary, three-sided, conductive cage so as to create capacitive fields that cancel inductive fields generated by the conductive half loop;

electrically insulating the conductive cage from the ground plane by disposing dielectric mounts between the conductive cage and the ground plane; and feeding the conductive half loop with a radio frequency (RF) signal to create an omni-directional, linearly polarized radiation pattern.

15. The method of claim 14, further comprising a step of mounting an even number of at least two tunable capacitors to the ground plane.

16. The method of claim 15, further comprising a step of dynamically tuning the antenna to a desired operating frequency by tuning the capacitors.

17. The method of claim 16, wherein the tuning is performed with a microcontroller.

18. The method of claim 16, wherein the dynamic tuning step is performed in response to changing environmental conditions experienced by the antenna.

19. The method of claim 17, wherein the capacitors are all tuned simultaneously to the same picofarad setting.

20. The method of claim 16, wherein the antenna is tunable between the frequencies of 250 to 350 MHz.

* * * * *